United States Patent [19]

Dal Pan et al.

[11] Patent Number: 4,491,170

[45] Date of Patent: Jan. 1, 1985

[54] DUMMY BAR WAGON FOR AN INSTALLATION FOR THE CONTINUOUS CASTING OF STEEL

[75] Inventors: Giacinto Dal Pan, Brescia; Giorgio Morali, Milan, both of Italy

[73] Assignee: Innse Innocenti Santeustacchio S.p.A., Brescia, Italy

[21] Appl. No.: 365,956

[22] Filed: Apr. 6, 1982

[30] Foreign Application Priority Data

Apr. 8, 1981 [IT] Italy ..... 20988 A-81

[51] Int. Cl.[3] ..... B22D 11/08

[52] U.S. Cl. ..... 164/426; 164/446

[58] Field of Search ..... 164/425, 426, 445, 446

[56] References Cited

U.S. PATENT DOCUMENTS 3,825,056 7/1974 Grosko et al. ..... 164/426
4,150,710 4/1979 John ..... 164/426 X
4,161,209 7/1979 Dangeleit et al. ..... 164/446

FOREIGN PATENT DOCUMENTS 37815 9/1972 Japan ..... 164/446
4298 2/1973 Japan ..... 164/426
139153 10/1980 Japan ..... 164/425

*Primary Examiner*—Nicholas P. Godici
*Assistant Examiner*—Richard K. Seidel
*Attorney, Agent, or Firm*—Birch, Stewart, Kolasch & Birch

[57] ABSTRACT

A dummy bar wagon is provided with a chain having two dog-shaped carriers spaced therealong to engage and disengage the dummy bar for loading it onto and unloading it from the wagon respectively. The loading and unloading operations are effected automatically by means of a device which suitably varies the linear velocity of the chain and the dummy bar relative to each other.

13 Claims, 4 Drawing Figures

DUMMY BAR WAGON FOR AN INSTALLATION FOR THE CONTINUOUS CASTING OF STEEL

BACKGROUND OF THE INVENTION

The present invention relates to a dummy bar wagon for an installation for the continuous casting of steel and similar molten metals, in which the dummy bar is flexible and is of the type having a linked structure like a chain.

More particularly, the invention concerns a wagon provided with a chain carrying first and second dog-shaped carriers arranged to engage respective seats formed close to the head and the tail of a dummy bar to load the dummy bar onto the wagon at one end thereof, move it towards the opposite end, and unload it from the wagon for insertion from above into a mold of a continuous-casting installation.

It is known that, after steel casting has been started in an installation of the type under consideration, the dummy bar is removed from the roller track which extends downstream of the mold, and is brought close to the mold to be inserted therein from above at the beginning of a new casting. More particularly, the dummy bar is moved away from the roller track by means of a winch which lifts it and holds it suspended vertically in a position spaced from the ingot mold, generally called the dummy bar recovery station. A wagon movable on rails between the mold and the dummy bar recovery station transfers the dummy bar from the station to the mold when required.

The wagon is generally provided with apparatus and/or devices which are able to take the dummy bar from the holding members (hooks) of the lifting winch, load it onto the wagon and, when the wagon is close to the mold, unload it from the carriage, introducing it from above into the mold where it holds it suspended until it is locked by the usual means (nipping rollers) provided for this purpose. Generally, an endless chain (or several chains) is used for these operations, the chain extending longitudinally on the wagon, which supports it by rollers or driven wheels, and being provided with take up members for pulling and releasing the dummy bar. These members are, for example, constituted by two or more dog-shaped carriers fixed to the chain and formed so as to engage respective seats formed in the dummy bar rod.

The practicability, effectiveness, and timing of operation of these members have until now depended on the precision and regularity of operation of relatively complex mechanisms provided for their control and actuation.

The regularity and reliability of the operation of these mechanisms are often jeopardized by the weight and bulk of the dummy bar, which are known to be considerable, by its flexibility, and hence the known difficulties presented by its handling.

Other technical disadvantages of these mechanisms are constituted by the difficulty of their timing with other moving members, and the frequency of control and maintenance operations which they require.

SUMMARY OF THE INVENTION

The problem which is at the basis of this invention is that of providing a dummy bar wagon of the type under consideration, having apparatus for loading thereonto and unloading therefrom a dummy bar, and for introducing and holding the bar in a mold of a continuous-casting installation, in which the apparatus has structural and functional characteristics which overcome the disadvantages mentioned above with reference to the prior art.

The idea for solving this problem is that of conferring on the dummy bar, when unloading it from the wagon, a linear velocity of displacement which is greater than that of the chain, while a dog-shaped carrier is engaged with the respective seat formed close to the tail of the dummy bar.

According to a basic aspect of this invention, there is provided a dummy bar wagon having a loading end and an unloading end for the dummy bar, and which includes: an endless chain supported and driven by means of a forward sprocket wheel and a rear sprocket wheel and having an upper active pass extending longitudinally of the wagon between the loading and unloading ends; means defining a plane for supporting the dummy bar during its transfer from the loading end to the unloading end, the support plane extending above the active pass of the endless chain at a predetermined distance therefrom, and first and second dog-shaped carriers fixed to the chain in mutually spaced relation for engaging respective seats formed close to the head and the tail of the dummy bar, wherein it further includes means defining a cylindrical surface at the loading end coaxial with the rear sprocket wheel, the cylindrical surface having a radius of curvature greater than the radius of the rear sprocket wheel, and being connected to the support plane so as to support the dummy bar during loading thereof onto the wagon.

Preferably, the cylindrical surface is defined by a pair of idle rollers which are supported coaxially on the rear sprocket wheel, and have a diameter greater than the wheel.

According to a further preferred characteristic of the invention, the support plane for the dummy bar is extended at the unloading end by a portion of a roller table which extends beyond the forward sprocket wheel and has a curved profile with a descending slope.

BRIEF DESCRIPTION OF THE DRAWING

One embodiment of the invention will now be described, by way of a non-limiting example, with reference to the appended drawings, in which.

DETAILED DESCRIPTION OF ONE PREFERRED EMBODIMENT OF THE INVENTION

Figure 1:
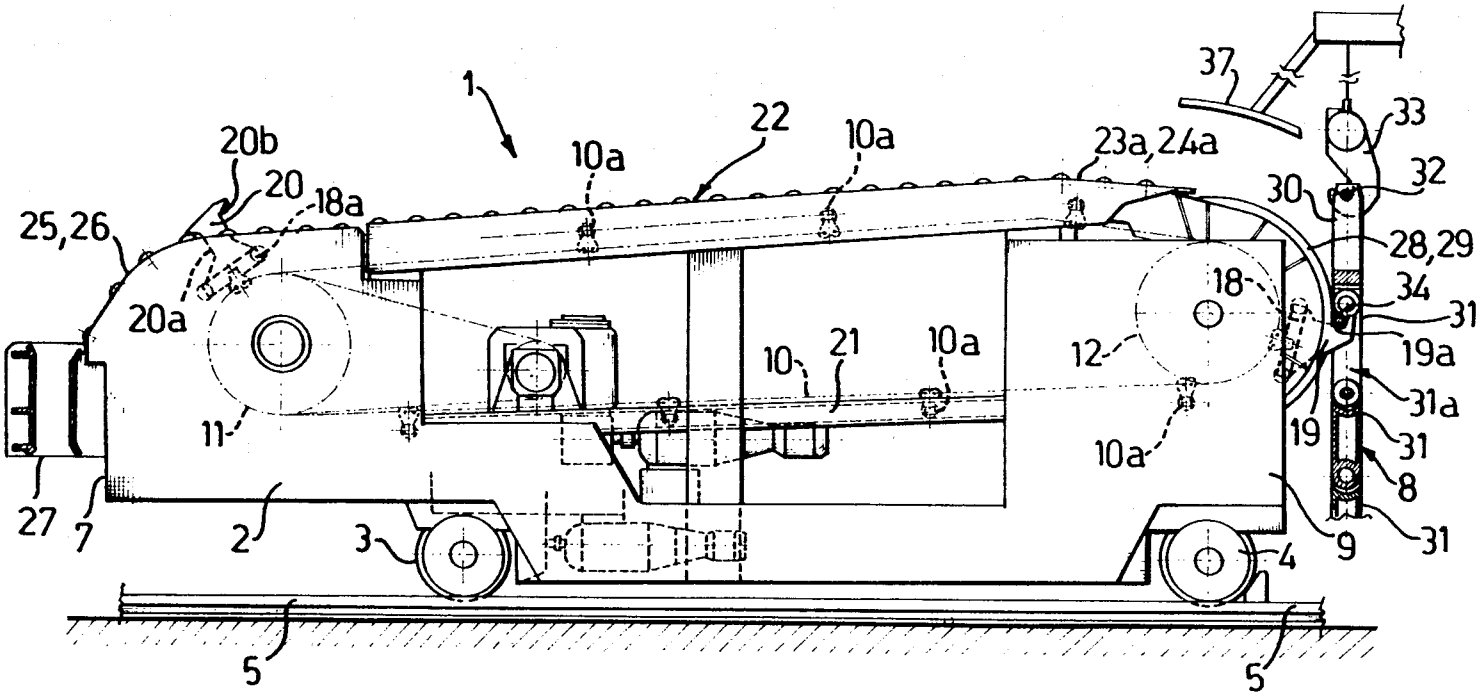
FIG. 1 is a schematic side elevational view of a dummy bar wagon according to the invention during loading of a dummy bar.
Figure 4:
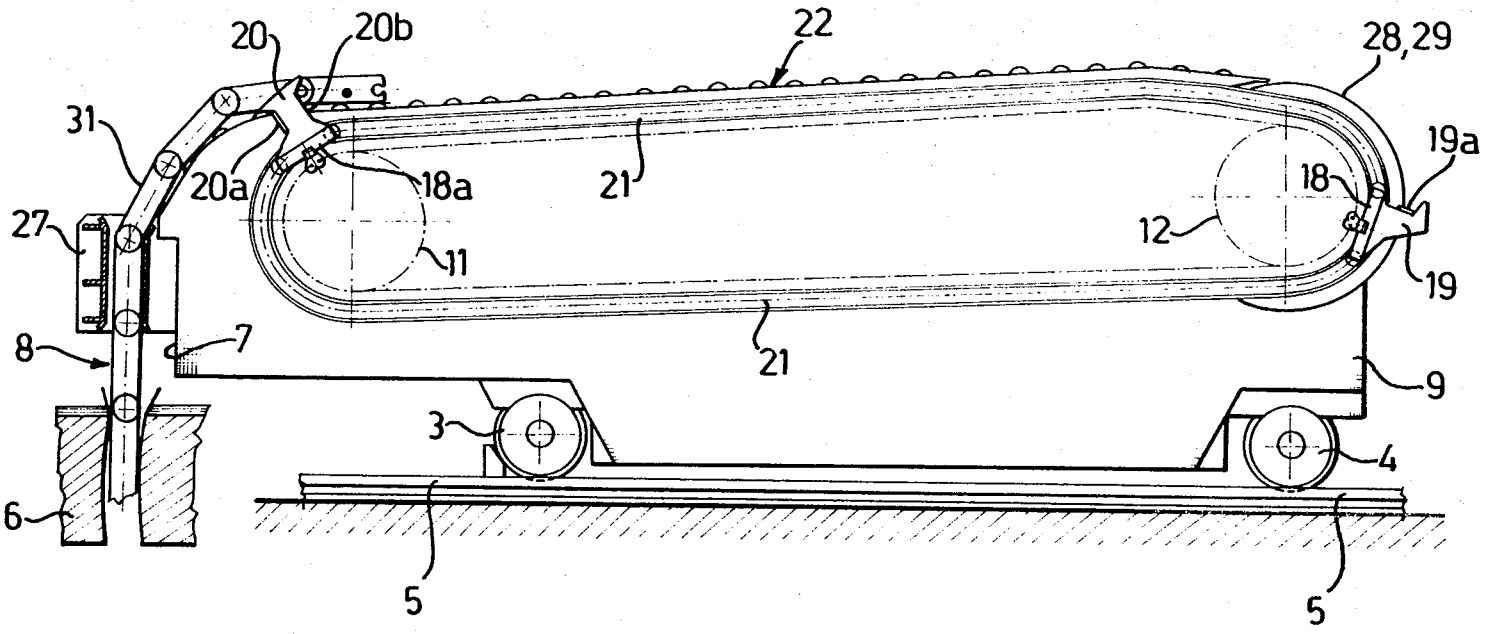

With reference to the drawings, a dummy bar wagon 1 of a continuous-casting installation has a support structure 2 provided with pairs of wheels 3, 4 for moving on rails 5 from a dummy bar recovery station (indicated by SR in FIG. 1) to a mold shown schematically by 6 in FIG. 4. On the wagon 1 is shown a rear end or loading end 9 at which a dummy bar 8 is loaded onto the wagon, as will become clearer from the description below, and a forward or unloading end 7, at which the dummy bar is unloaded from the wagon to be inserted, when required, in the mold 6.

By 10 is generally indicated a multiple endless roller chain, in particular a triple chain, extending longitudinally in a median position on the wagon 1 on which it is supported by forward and rear sprocket wheels 11, 12 respectively.

Of these sprocket wheels, the rear wheel 12 is idle while the forward wheel 11 is driven by any conventional means. Preferably, the driven wheel 11 is mounted on a shaft 13 to which is keyed a further sprocket wheel 14 connected kinematically to a pinion 15 keyed to the shaft 16 of a geared motor unit 17. This geared motor unit is mounted on the wagon 1. The direction of rotation of the driven wheel 11 is such that the upper pass of the endless chain 10 moves from the loading end 9 towards the unloading end 7 of the wagon 1.

In a preferred embodiment, the sprocket wheels 11, 12 are identical and their respective horizontal axes of rotation are located at different heights. In particular, the idle wheel 12 is higher than the driven wheel 11 so that the upper and lower passes of the endless chain 10 are inclined at a predetermined angle to the horizontal downwardly towards the forward, unloading end of the wagon 1.

By 10*a* is shown each roller of a plurality of identical rollers fixed to the endless chain 10 at predetermined intervals and engaging in guide rails 21, 21 which extend parallel to the chain.

By 18 is shown schematically a carriage which is fixed, by conventional means not shown, to the endless chain 10 in a predetermined position and supports a dog-shaped carrier 19 used for taking up the dummy bar 8 at the recovery station and loading it onto the wagon 1, as will emerge from the following description. The frontal profile or thrust profile of the dog-shaped carrier 19, which will also be called the "first dog-shaped carrier" below, is indicated at 19*a*.

To the chain 10, and at a predetermined distance from the carriage considered above, is fixed a second carriage 18*a* which carries a second dog-shaped carrier 20 used for pushing and then holding the dummy bar 8, as will emerge from the following description. Of this dog-shaped carrier 20, the frontal, thrust profile is shown as 20*a*, and the rear profile for holding the dummy bar is shown as 20*b*. The carriages 18, 18*a*, which carry the dog-shaped carriers 19, 20 are engaged laterally with those guides 21, 21 mentioned above.

Figure 2:
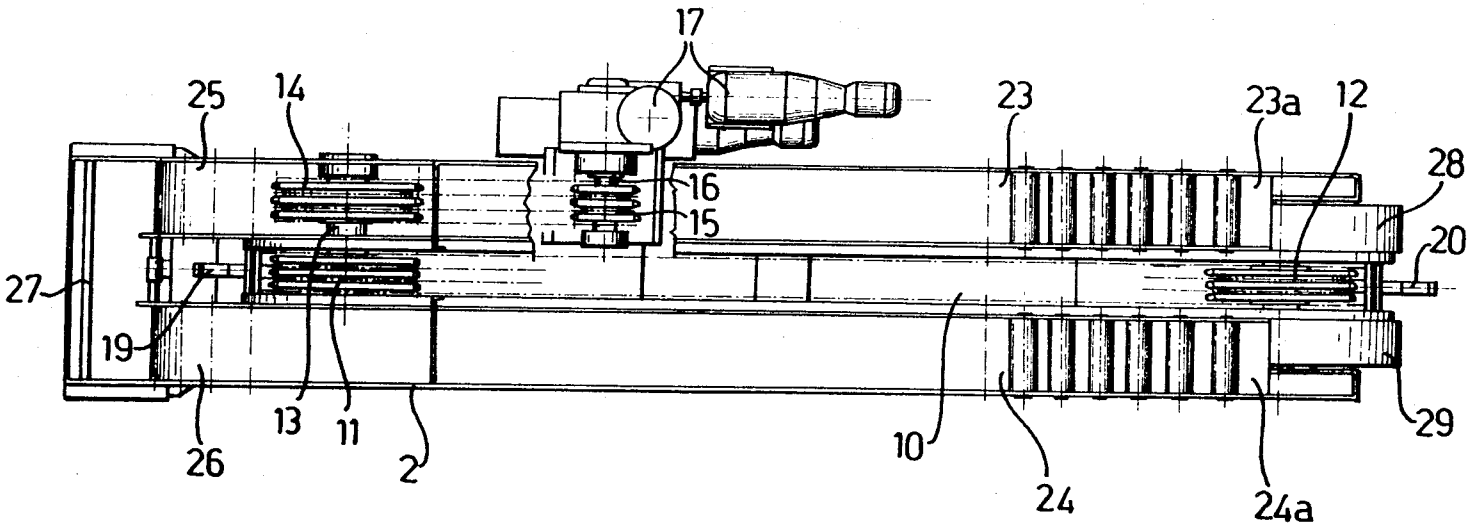
FIG. 2 is a top plan view of the dummy bar wagon of FIG. 1.
Figure 3:
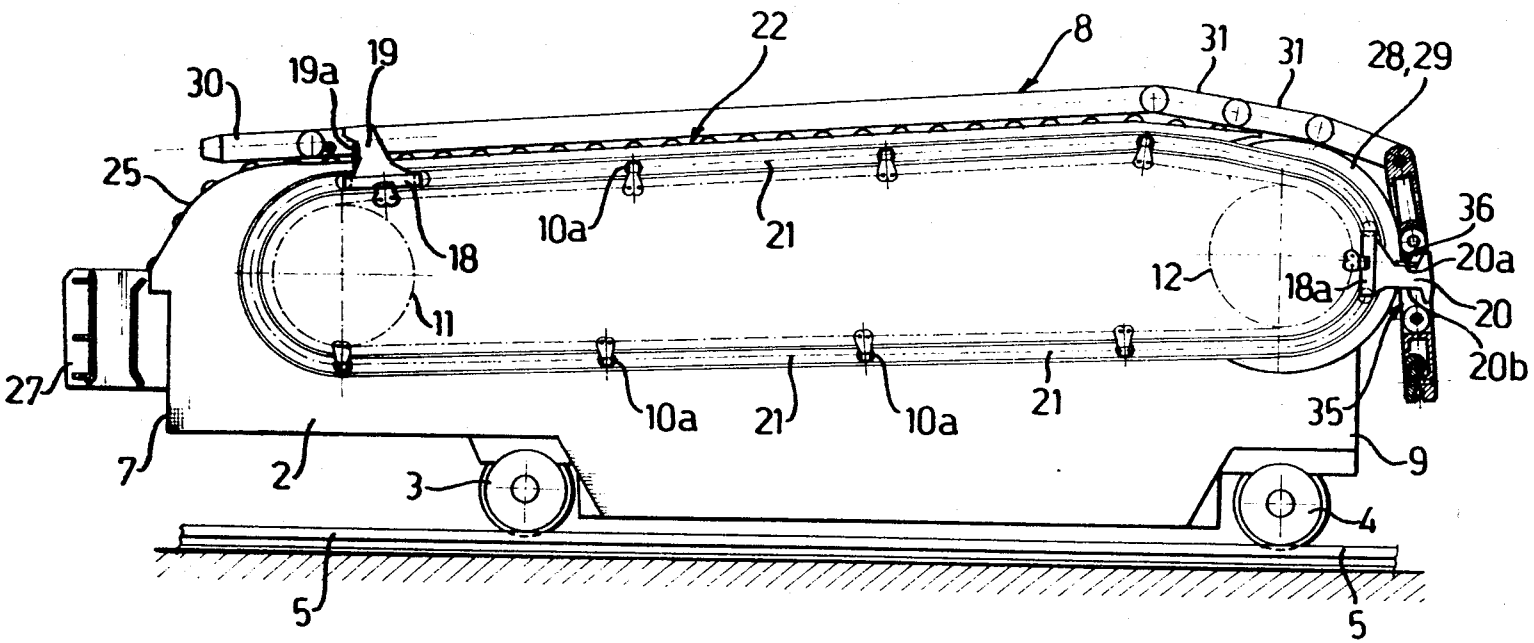
FIGS. 3 and 4 show the wagon of FIG. 1 schematically, with apparatus for taking up, transferring, and discharging from the wagon a dummy bar of a continuous-casting installation in two different moments of operation.

The support structure 2 of the wagon 1 supports, above the upper or active pass of the chain 10, and at a predetermined distance therefrom, a roller table 22 constituted by two roller tracks 23, 24 (FIG. 2), this table being intended to support the dummy bar 8 when loaded on the wagon 1.

These tracks 23, 24 extend symmetrically and parallel relative to the upper pass of the endless chain 10 and, consequently, are inclined to the horizontal at a predetermined angle downwardly towards the unloading end 7 of the wagon 1.

Right at this unloading end 7, the roller tracks 23, 24 are extended by respective roller track portions 25, 26 which are identical and project beyond the driven wheel 11 of the chain 10 by a predetermined distance. Each of the roller track portions 25, 26 has a curved profile with a descending slope and terminates in correspondence with the mouth of a vertical guide tunnel 27 which is fixed to the front end of the wagon 1 and has transverse dimensions such as to allow the guided passage of the dummy bar 8.

At the loading end 9, the wagon 1 supports two identical idle rollers 28, 29 which have diameters greater than the diameter of the sprocket wheel 12, are coaxial with the sprocket wheel 12, and are located on each side thereof. The cylindrical outer surfaces of the rollers 28, 29 are connected to the higher end (the loading end) of the roller tracks 23, 24 by respective track portions 23*a*, 24*a*.

The dummy bar 8 is of the flexible type, and is constituted by a head 30, essentially in the form of a trident, and a plurality of links, each indicated 31, which are articulated together in a conventional manner. In the head 30 is fixed a cross bar 32 with which the hook 33 of a lifting winch (not shown) is intended to cooperate.

In the first link 31, articulated to the head 30 of the dummy bar, is formed longitudinally an aperture 31*a* which constitutes a seat for engagement by the first dog-shaped carrier 19, as will emerge from the following description. A pin 34 is fixed transversely in correspondence with the front end of the aperture 31*a*. In the last of the links 31, a similar aperture 35 is formed longitudinally and constitutes a seat for engagement by the second dog-shaped carrier 20. Close to the front end of this seat 35, a pin 36 is fixed transversely. Clearly, the length of the apertures or seats 31*a*, 35 mentioned above, and, more precisely, the portions thereof defined at the front by the pins 34, 36 and at the rear by the chain pins, is arranged to allow the easy insertion of the first and second dog-shaped carriers 19, 20. Moreover, the dog-shaped carriers are formed with profiles specially designed, as shown in the appended drawings, to facilitate their disengagement from the respective seats.

The operation of the dummy bar wagon according to the invention is as follows.

In an initial condition, the dummy bar 8 is lifted from the conventional roller track (not shown) for removal of the bar from a continuous-casting installation, by means of a lifting winch, is supported by the hook 33 at the dummy bar recovery station SR, and the wagon 1 is locked on the rails 5 close to the dummy bar. It should be noted that, by means of the hook 33, the dummy bar 8 is held vertically at a height such that the aperture 31*a* is at a level substantially corresponding to that of the axis of the rear sprocket wheel 12.

The endless chain 10 is advanced by actuating the geared motor unit 17 until the first dog-shaped carrier 19 is inserted in the respective seat 31*a* of the dummy bar 8, engaging the pin 34 actively with its front profile (or thrust profile) 19*a*. The advancement of the chain 10 being continued, the dummy bar 8 is lifted and thereby disengaged from the hook 33 of the lifting winch. When this disengagement is complete, the head 30 and the first link 31 of the dummy bar 8 are placed on the idle rollers 28, 29, this positioning being facilitated by the presence of a tile-shaped deflector 37 and by the particular internal profile of the hook 33.

The advancement of the chain 10 being continued, the dummy bar 8 is completely loaded onto the roller table 22, while the second dog-shaped carrier 20 is brought closer to the engagement provided by the respective seat 35 of the dummy bar.

The position of the second dog-shaped carrier 20 relative to the seat 35 during their mutual engagement corresponds substantially to the position in which the engagement of the dog-shaped carrier 19 with its respective receiving seat 31*a* had previously occurred. It should be noted that, during the insertion of the dog-shaped carrier 20 into the aperture 35, the front or thrust profile 20*a* of this dog-shaped carrier 20 is angularly rearward of the pin 36. The active (thrust) engagement between the dog-shaped carrier 20 and the pin 36 occurs only in a subsequent period, because of the greater angular velocity of the dog-shaped carrier 20 relative to the pin 36 of dummy bar 8.

When the active engagement of the thrust profile 20*a* of the dog-shaped carrier 20 and the pin 36 has occurred the angular velocities of the dog-shaped carriers and the dummy bar coincide, while the peripheral velocity (Vfb) of the dummy bar is greater than that (Vc) of the dog-shaped carriers according to the relation:

$$V_{fb} = V_c (R_1/R_2)$$

where $R_1$ is the radius of curvature of the trajectory of the false bar and $R_2$ is the radius of curvature of the guide for the dog-shaped carriers ($R_1 > R_2$).

Consequently, close to the unloading end 7 of the wagon 1, the dummy bar 8 advances beyond the dog-shaped carrier 19 which "moves backwards" in its seat 31*a*, detaching itself from the pin 34. Subsequently, while the dummy bar passes over the roller tracks 25, 26, the dog-shaped carrier 19, moving through its own circular trajectory, leaves the seat 31*a*.

The movement being continued, the dummy bar, still thrust by the dog-shaped carrier 20, passes through the guide 27 and then into the mouth of the mold 6 from above. The dummy bar is then subject to a strong pulling effect, due to the component of gravity from the weight of the links 31, which moves it vertically.

When this component of gravity overcomes the horizontal force due to the weight of the remaining links 31 and the coefficient of friction between the remaining links and the rollers of the tracks 23, 24, the dummy bar 8 accelerates relative to the dog-shaped carrier 20. Consequently, the thrust profile 20*a* of this dog-shaped carrier 20 is spaced from the pin 36, while the holding profile 20*b* of the dog-shaped carrier itself engages the pin 36*a* of the dummy bar. From this moment, the dummy bar 8 falls into the mold 6 at the velocity of the dog-shaped carrier 20, being held by the latter.

When the dummy bar 8 has reached a predetermined position in the mold 6, the movement of the chain 10 is stopped and the dummy bar is maintained suspended by the dog-shaped carrier 20 until the operation of the conventional locking device for the dummy bar within the continuous-casting machine.

We claim:

1. A dummy bar wagon for an installation for the continuous casting of steel and similar molten metals, in which the dummy bar is flexible and is formed essentially as a chain with respective seats close to the head and tail thereof, the wagon having a loading end and an unloading end for said dummy bar and including: an endless chain having an upper active pass extending longitudinally of said wagon between said loading and unloading ends; a forward sprocket wheel and a rear sprocket wheel for supporting and driving said chain; support means defining a plane for supporting said dummy bar during its transfer from said loading end to said unloading end, said plane of said first support means extending above said active pass of said endless chain at a predetermined distance therefrom, and first and second non-retractable dog-shaped carriers fixed to said chain in mutually spaced relation for engagement at successive times at said loading end with a respective one of said seats in said dummy bar, wherein the improvement comprises said wagon further including a surface means which defines a cylindrical surface at said loading end coaxial with said rear sprocket wheel, whereby the cylindrical surface means has a radius of curvature greater than the radius of said rear sprocket wheel, which displaces said endless chain by an amount equal to the difference in the two radii and is operatively positioned adjacent to said support plane so as to support the dummy bar during loading thereof onto the wagon.

2. A wagon as defined in claim 1, wherein said surface means defining said cylindrical surface comprise a pair of idle rollers supported coaxially with said rear sprocket wheel and having a diameter greater than said wheel.

3. A wagon as defined in claim 2, wherein it includes a roller table portion supported at said unloading end as a prolongation of said support plane, said roller table portion extending beyond said forward sprocket wheel and having a curved profile with a descending slope.

4. A dummy bar wagon for an installation for the continuous casting of molten metal, comprising:

an endless chain having an upper active pass extending between a loading and an unloading end of said wagon;

a forward sprocket wheel and a rear sprocket wheel for supporting and driving said endless chain;

support means defining a plane above the active pass of said endless chain for supporting an elongate flexible dummy bar during transfer thereof from said loading end to said unloading end, said dummy bar having a head seat close to the head thereof and a tail seat close to the tail thereof;

first and second non-retractable dog-shaped carriers fixed to said chain in mutually spaced relation for engagement at successive times at said loading end with said head seat and said tail seat of said dummy bar; and surface means for defining a curved surface having a radius of curvature greater than the radius of said rear sprocket wheel at said loading end coaxial with said rear sprocket wheel, said surface means being arranged adjacent to said support plane so as to support the dummy bar during loading thereof onto the wagon, wherein said surface means displaces said endless chain causing said second dog-shaped carrier to have a peripheral velocity at the point of engagement with said dummy bar which is greater than the velocity of said dummy bar before engagement with said second carrier to thereby increase the rate of transfer of said dummy bar to cause the dummy bar to advance beyond said first dog-shaped carrier which moves backward in said head seat to disengage said first dog-shaped carrier from said head seat.

5. A wagon as defined in claim 4, wherein said plane is inclined downwardly toward said unloading end of said wagon.

6. A wagon as defined in claim 4, wherein said first dog-shaped carrier has a first thrusting surface adapted to thrust said dummy bar toward said unloading end of said wagon and a second holding surface adapted to limit the movement of said dummy bar toward said unloading end of said wagon.

7. A wagon as defined in claim 5, wherein said first dog-shaped carrier has a frontal thrusting surface adapted to thrust said dummy bar toward said unloading end of said wagon and a second holding surface adapted to limit the forward movement of said dummy bar toward said unloading end of said wagon as it moves down said inclined surface.

8. A wagon as defined in claim 4, wherein said surface means includes a roller having a radius of curvature greater than the radius of said rear sprocket wheel.

9. A wagon as defined in claim 8, wherein said at least one roller comprises an idle roller having a radius of curvature greater than the radius of said rear sprocket wheel.

10. A wagon as defined in claim 4, wherein said surface means includes a pair of idle rollers arranged on each side of said rear sprocket wheel, each of said idle rollers having a radius of curvature greater than the radius of said rear sprocket wheel.

11. A wagon as defined in claim 4, and further including a table portion supported at said unloading end as a prolongation of said support plane, said table portion extending beyond said forward sprocket wheel and having a curved profile with a descending slope.

12. A wagon as defined in claim 11, wherein said first dog-shaped carrier passes through said table portion wherein said first dog-shaped carrier is disengaged from said head seat of said dummy bar.

13. A dummy bar wagon for an installation for the continuous casting of molten metal, comprising:

an endless chain having an upper active pass extending longitudinally of said wagon between a loading and an unloading end of said wagon;

a forward sprocket wheel and a rear sprocket wheel for supporting and driving said endless chain;

support means defining a plane for supporting an elongate flexible dummy bar having a head seat close to the head thereof and a tail seat close to the tail thereof during transfer of a dummy bar from said loading end to said unloading end, said support plane extending above said active pass of said endless chain;

first and second dog-shaped carriers fixed to said chain in mutually spaced relation for engagement at successive times at said loading end with a respective one of said seats in said dummy bar; and surface means for defining a curved surface having a radius of curvature greater than the radius of said rear sprocket wheel at said loading end coaxial with said rear sprocket wheel, said surface means being operatively arranged adjacent to said support plane so as to support the dummy bar during loading thereof onto the wagon.

* * * * *